US008499945B2

(12) United States Patent
Karp et al.

(10) Patent No.: US 8,499,945 B2
(45) **Date of Patent: *Aug. 6, 2013**

(54) CRANE, IN PARTICULAR MOBILE CRANE WITH A NARROW TRACK AND ENLARGED SUPPORTING BASE

(75) Inventors: Günter Karp, Herschberg (DE); Fritz-Botho Köster, Rockenhausen (DE); Rüdiger Zollondz, Hornbach (DE); Alfons Weckbecker, Zweibrücken (DE)

(73) Assignee: Terex Cranes Germany GmbH, Zweibruecken (DE)

( * ) Notice: Subject to any disclaimer, the term of this patent is extended or adjusted under 35 U.S.C. 154(b) by 230 days.

This patent is subject to a terminal disclaimer.

(21) Appl. No.: 11/992,718

(22) PCT Filed: Aug. 22, 2006

(86) PCT No.: PCT/DE2006/001479

§ 371 (c)(1), (2), (4) Date: May 20, 2008

(87) PCT Pub. No.: WO2007/036188

PCT Pub. Date: Apr. 5, 2007

(65) Prior Publication Data

US 2009/0107946 A1 Apr. 30, 2009

(30) Foreign Application Priority Data

Sep. 28, 2005 (DE) ..... 10 2005 047 745

(51) Int. Cl.
*B66C 23/78* (2006.01)

(52) U.S. Cl.
USPC ..... 212/302; 212/301

(58) Field of Classification Search
USPC ..... 212/302–305, 258, 324, 271, 301, 212/277, 306
See application file for complete search history.

(56) References Cited

U.S. PATENT DOCUMENTS 2,131,479 A * 9/1938 McGiffert et al. ..... 212/305
2,914,194 A 11/1959 Brown (Continued)

FOREIGN PATENT DOCUMENTS

DE 23 64 296 6/1975
DE 25 17 203 10/1976

(Continued)

OTHER PUBLICATIONS

Japanese Office Action dated Jan. 26, 2012 for JP Application No. 2008-532578, translation only.

(Continued)

*Primary Examiner* — Sang Kim
*Assistant Examiner* — Juan Campos, Jr.
(74) *Attorney, Agent, or Firm* — Browdy and Neimark, PLLC

(57) ABSTRACT

A mobile crane includes an undercarriage with a middle section and two parallel crawler carriages; a superstructure on which a boom is mounted, the superstructure being connected to the undercarriage by a rotary joint; two longitudinal outriggers connected to the undercarriage and extending in the longitudinal direction between the crawler carriages; and two transverse outriggers connected to the undercarriage and extending outside the crawler carriages. One of the longitudinal outriggers has an end with a transverse beam supported by spaced apart outrigger cylinders which provide an extended tipping edge to further stabilize the crane.

17 Claims, 7 Drawing Sheets

U.S. PATENT DOCUMENTS

| | | | | | |
|---|---|---|---|---|---|
| 3,878,944 | A | * | 4/1975 | Beduhn et al. | 212/303 |
| 4,196,816 | A | * | 4/1980 | Dvorsky et al. | 212/195 |
| 4,387,814 | A | * | 6/1983 | Beduhn et al. | 212/195 |
| 4,394,912 | A | | 7/1983 | Epps et al. | |
| 4,394,913 | A | | 7/1983 | Lanning et al. | |
| 4,446,976 | A | * | 5/1984 | Imerman et al. | 212/304 |
| 4,579,234 | A | * | 4/1986 | Delago et al. | 212/178 |
| 6,138,845 | A | | 10/2000 | Kaspar | |
| 6,360,905 | B1 | | 3/2002 | Frommelt et al. | |
| 7,178,682 | B2 | * | 2/2007 | Willim | 212/302 |
| 2002/0056694 | A1 | | 5/2002 | Rode et al. | |

FOREIGN PATENT DOCUMENTS

| | | | | |
|---|---|---|---|---|
| DE | 1 29 892 | | | 2/1978 |
| DE | 33 39 863 | | | 6/1984 |
| DE | 33 10 491 | | | 10/1984 |
| DE | 100 20 270 | | | 2/2001 |
| DE | 101 43 716 | | | 3/2003 |
| EP | 0048076 | A | * | 3/1982 |
| GB | 1 554 735 | | | 10/1979 |
| GB | 1 554 735 | A | * | 10/1979 |
| GB | 2 135 258 | | | 8/1984 |
| JP | 60-009896 | U | | 1/1985 |
| JP | 60-170392 | U | | 11/1985 |
| JP | 4-31507 | A | * | 2/1992 |
| JP | 7-228485 | A | * | 8/1995 |
| WO | 98/05581 | A2 | | 2/1998 |

OTHER PUBLICATIONS

Search Report dated Mar. 7, 2007 issued for the underlying International PCT Application No. PCT/DE2006/001479.

Written Opinion of the Intl'l Search Authority issued for the underlying International PCT Application No. PCT/DE2006/001479.

* cited by examiner

CRANE, IN PARTICULAR MOBILE CRANE WITH A NARROW TRACK AND ENLARGED SUPPORTING BASE

CROSS-REFERENCE TO RELATED APPLICATIONS

This is a U.S. national stage of International Application No. PCT/DE2006/001479, filed on 22 Aug. 2006. Priority is claimed on German Application No. 10 2005 047 745.3, filed on 28 Sep. 2005.

BACKGROUND OF THE INVENTION

1. Field of the Invention

The invention pertains to a crane of the type having a superstructure connected to an undercarriage by a rotary joint, and outriggers which enlarge the support base.

2. Description of the Related Art

As a rule, cranes with rubber-tired travel carriages are equipped with outriggers (see FIG. 9). The lifting of loads is usually possible only when the crane is standing on the outriggers. Cranes with a crawler-type carriage usually do not have outriggers but rather lift loads while standing on the crawlers and can also usually travel while carrying the load. To obtain a wider support base, crawler-mounted cranes can also be equipped with outriggers. FIG. 10 shows the undercarriage of the Demag CC/PC 3800. The most important components are illustrated schematically in FIG. 11. The arrow 1 indicates the direction of travel. Four arms 4 extend from the center of rotation 2 to the crawlers 3. Four outriggers 5 are attached on the outside of the crawlers. A crane of this type can be operated either while standing on the crawlers or while standing on the outriggers. During operation on the outriggers, this arrangement is characterized by a direct flow of force, which is desirable. Nevertheless, the forces and moments must be transmitted through the crawlers 11. At the ends of the crawlers there are idler wheels, gearboxes, and crawler take-up devices. As a result, it is difficult to transmit the forces through at these points. FIG. 12 shows an undercarriage similar to that of FIG. 11. Here the crawlers are connected to each other by a middle section 6. This middle section represents the conventional design for a crawler-mounted crane without outriggers. There is usually sufficient room in the center of the crawler frame to make it relatively easy to install the components and to bolt them together. During operation on the outriggers, however, the forces are usually not distributed uniformly in the outriggers. As a result, torque is created in the middle section 6 and also in the crawlers 3. In FIG. 13, not only the middle section 6 but also the outriggers 7 are attached to the centers of the crawlers. This relieves the crawlers 3 of load.

SUMMARY OF THE INVENTION

The invention is based on the task of equipping a crane, especially a mobile crane on a narrow crawler-type carriage, with outriggers in such a way that an extended support base is obtained.

This task is accomplished by a crane, especially a mobile crane, having an undercarriage and a superstructure, on which a boom is mounted, where the superstructure is connected to the undercarriage by a rotary joint, and where several outriggers are provided on the crane to increase the size of the support base. The undercarriage includes a middle section and two parallel crawler-type carriages, one on each side of the middle section. Four outriggers are provided, which are connected to the undercarriage, where their orientation is fixed in such a way that each one forms a 90° angle to the other, and where two of the outriggers are oriented in the longitudinal direction of the undercarriage and two are oriented transversely to it.

As a result of the arrangement of the outriggers in the longitudinal direction and in the direction transverse to the undercarriage, a direct flow of force is obtained. As a result, there are no avoidable torques. The forces and stresses which occur are smaller. Less material is required. Weight and costs are reduced. In addition, the points at which the outriggers are connected to the travel carriage are always at right angles. Outriggers can usually be attached more easily and more quickly at a right angle than at a slant. The amount of space occupied by the connection is also smaller.

The outriggers are preferably arranged parallel to the crawlers and perpendicular to the crawlers, and they intersect at the center of rotation. The concrete design can deviate from this. The point is, however, that the ends of the outriggers which are transverse to the travel direction lie outside the track and that the outriggers which are oriented in the travel direction are located inside the track.

According to one embodiment, the outriggers can be attached to the undercarriage in that at least one of the transversely oriented outriggers is attached directly to a crawler-type carriage.

It is also possible for the bottom surface of one of the lateral outriggers to be attached to the facing side of the crawler-type carriage and for the top surface to be attached to the middle section.

The longitudinally oriented outriggers can be attached directly to the middle section or to the side of the crawler-type carriage facing the middle section or to both the middle section and the crawler-type carriage.

According to another embodiment, the outriggers can be designed to telescope and to have the capacity to be folded up or to the side.

Extendable outrigger cylinders, which establish contact with the support surface, are mounted at the ends of the outriggers.

A special embodiment which is advantageous both for stationary and for mobile cranes includes at least one outrigger designed as a tipping edge standing on two points.

To accomplish this, a transverse beam can be attached to the end of the outrigger, and two outrigger cylinders can be mounted on the transverse beam a certain distance apart.

The outrigger cylinders can be extended either hydraulically or by means of spindle drives.

Finally, an additional outrigger cylinder can be mounted on the end of the outrigger in the center between the two outrigger cylinders mounted on the transverse beam.

The outrigger cylinders, according to another embodiment, can be connected at their free ends to an outrigger pad by way of ball joints, and it is possible for one of the outrigger cylinders mounted on the transverse beam to be supported on the beam with freedom to rotate around an axis transverse to its longitudinal axis to exclude any possible straining forces.

DETAILED DESCRIPTION OF THE PREFERRED EMBODIMENTS

Figure 1:
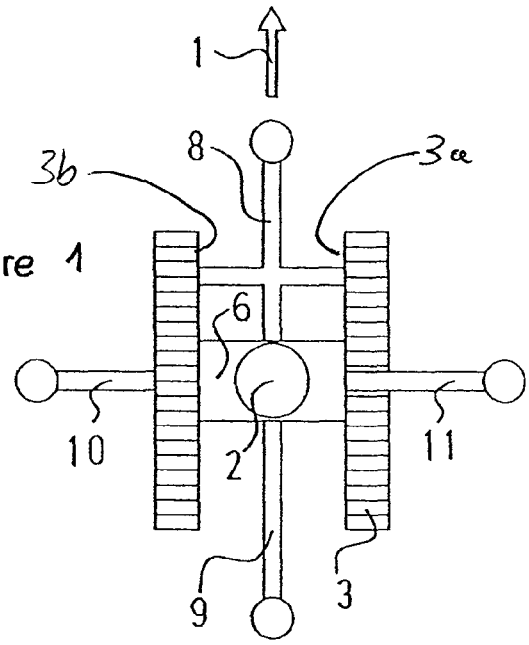
FIG. 1 shows a top view of the crawler-type carriage with outriggers.

According to the invention (FIG. 1), the crane has 4 outriggers. Looking in the travel direction, one outrigger 8 points forward and lies inside the track. One outrigger 9 points to the rear and lies inside the track. One outrigger 10 points to the left and lies outside the track. One outrigger 11 points to the right and lies outside the track. In this arrangement, all the outriggers are subjected purely to bending. The crawlers 3 each include an inner side 3*a* and 3*b*. These inner sides 3*a* and 3*b* face each other. The middle section 6 and the crawlers 3 are not subject to torsion either. The outriggers 8-11 are connected to the crawlers 3 and to the middle section 6 at right angles in areas where there is plenty of room to work.

Figure 2:
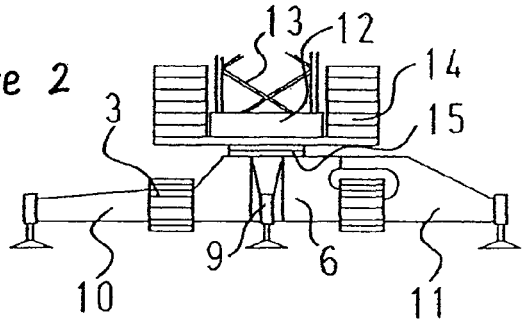
FIG. 2 shows a view from the rear.

FIG. 2 shows an inventive crane from the rear. The superstructure 12 with the boom 13 and the counterweight 14 is connected rotatably to the middle section 6 by a rotary joint 15. With this arrangement, as can be seen in FIG. 2, the outriggers can be relatively long, as a result of which strong moments develop in the outriggers. Because the left outrigger 10 passes through the crawler 3, the height of the outrigger 10 is limited by the height of the crawler.

The way in which the right outrigger 11 is attached eliminates this restriction. The bottom surface of the outrigger 11 is connected to the right crawler. The top surface is fastened to the middle section 6. It is also possible for the outrigger to be attached only to the middle section 3. In this case, there no need for any modifications to the crawler. If the outriggers 10, 11 are connected to the middle section, this connection must be located between the rotary joint and the connections to the crawlers. The rear outrigger 9 is attached only to the middle section. To reduce the moment in the outrigger, it, like the forward outrigger 8, can be attached both to the middle section and to the crawlers. Of course, it is also possible to attach the outriggers 8, 9 only to the crawlers.

Figure 3:
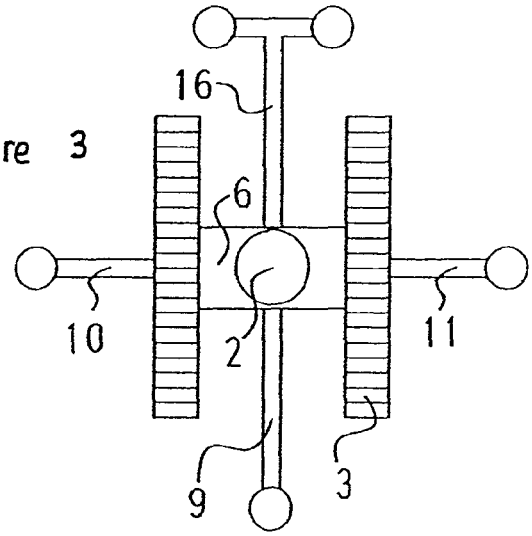
FIG. 3 shows a modified design of the outriggers with tipping edge.
Figure 4:
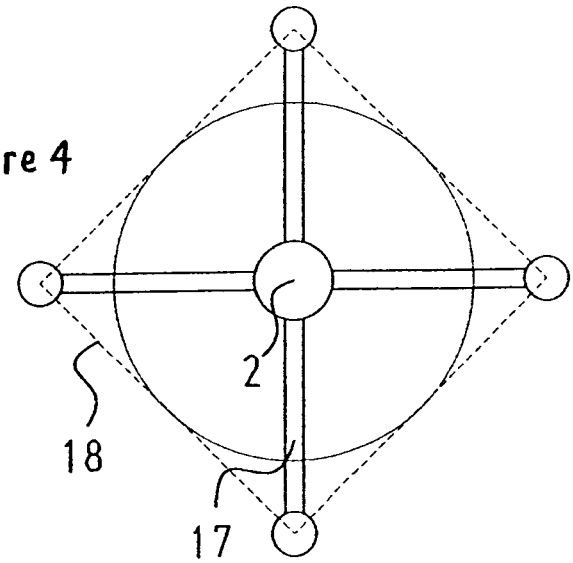
FIGS. 4 and 5 explain the tipping edge.
Figure 5:
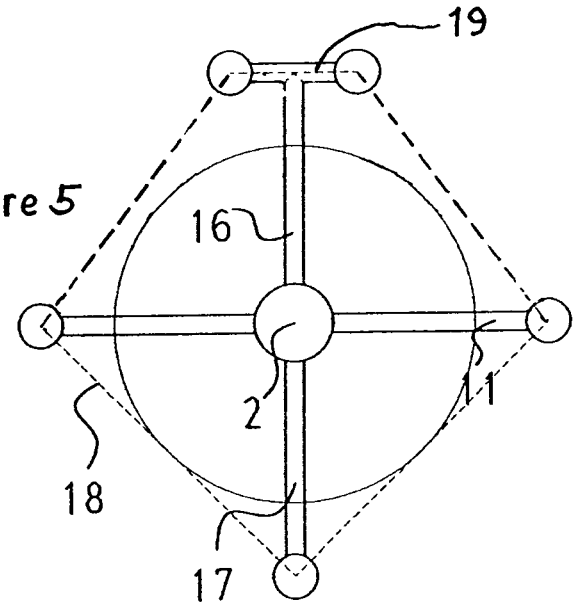

FIG. 3 shows another advantageous embodiment. One outrigger 16 is designed so that a tipping edge is formed on the outrigger. The advantage will be explained on the basis of FIGS. 4 and 5. In FIG. 4, 4 outriggers 17 are illustrated schematically, which are arranged on a circle centered on the center of rotation 2. The connecting line 18 between the ends of two adjacent outriggers is referred to as the "tipping edge" 18. If the crane were to lose its stability (accident), it would tip over this edge 18. If an outrigger 16 (FIGS. 4 and 5) is designed so that it stands on 2 points, a tipping edge 19 is formed, which is farther away from the center of rotation than the conventional tipping edges 18. When the boom is standing over this outrigger, therefore, the load moment is higher. This higher load moment can be used to carry out especially heavy lifts or to raise especially long booms from the ground.

Figure 6:
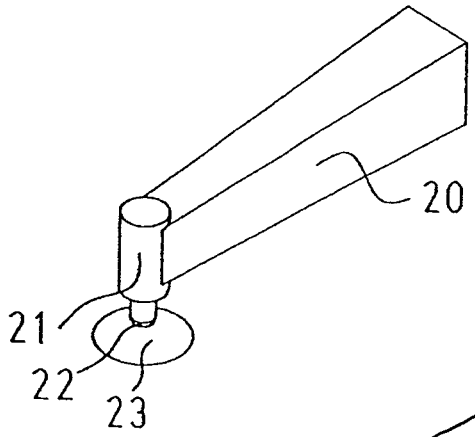
FIGS. 6-8 show designs of an outrigger.

Other possible embodiments of these types of outriggers will be explained on the basis of FIGS. 6, 7, and 8. FIG. 6 shows a typical conventional outrigger. A hydraulic cylinder 21, which is connected to an outrigger plate 23 by means of a ball joint 22, is attached to the end of the outrigger support beam 20. The ball joint compensates for small irregularities in the surface of the ground. An inventive outrigger must have a tipping edge at its end. One possible design (FIG. 7) consists of an outrigger with an outrigger cylinder 21 and two additional outriggers 24, which are mounted laterally on a transverse beam 25 attached to the end of the outrigger support beam 20. During normal operation of the crane, the middle outrigger cylinder 21 will be used. To activate the additional support edge, the lateral outriggers 24 are extended. This can be done hydraulically or by means of spindle drives. Foldaway or plug-in outriggers are also possible. FIG. 8 shows another embodiment. In the forward area, two outrigger cylinders 26, 27 are mounted on a transverse beam 29. They are connected to an outrigger pad 28 by ball joints. To exclude the possibility of straining forces, one of the cylinders 27 is mounted rotatably in the transverse beam 29. When the additional tipping edge is activated, hydraulic oil is trapped in the cylinders. The arrangement is then rigid. During normal operation of the crane (on the standard support base), the cylinders are connected hydraulically in series, so that oil can flow unhindered from one cylinder to the other. Thus the outrigger pad can rotate around a point between the cylinders. This possibility of being able to switch between normal operation and operation with an extended tipping edge is not absolutely necessary. Nevertheless, it ensures that the pressure under the outrigger pad (28) is distributed uniformly over the ground.

Figure 7:
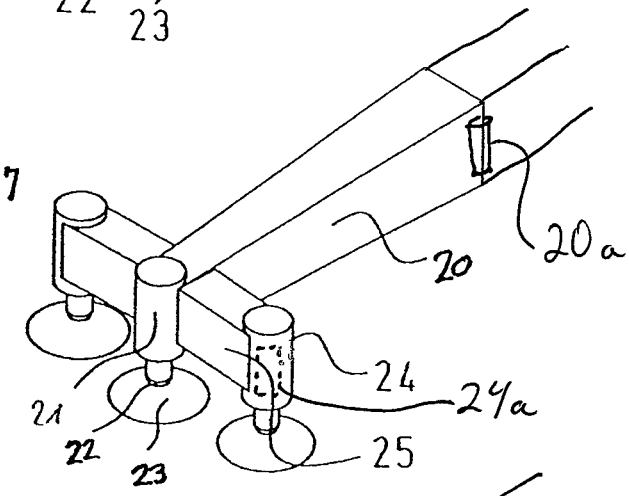
Figure 8:
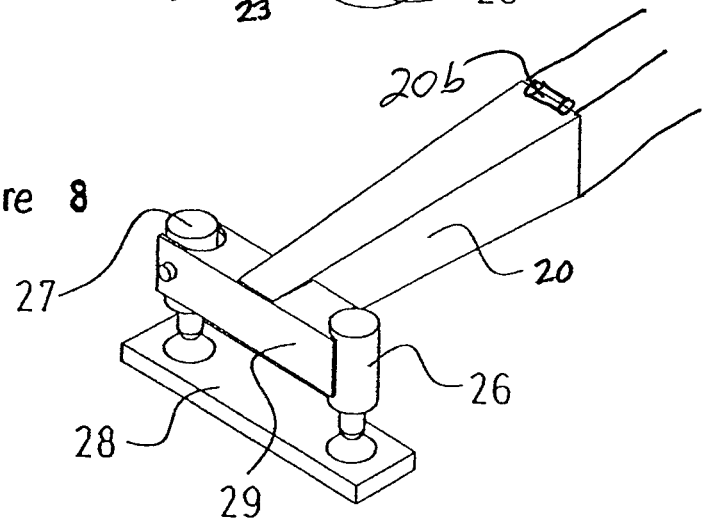
Figure 9:
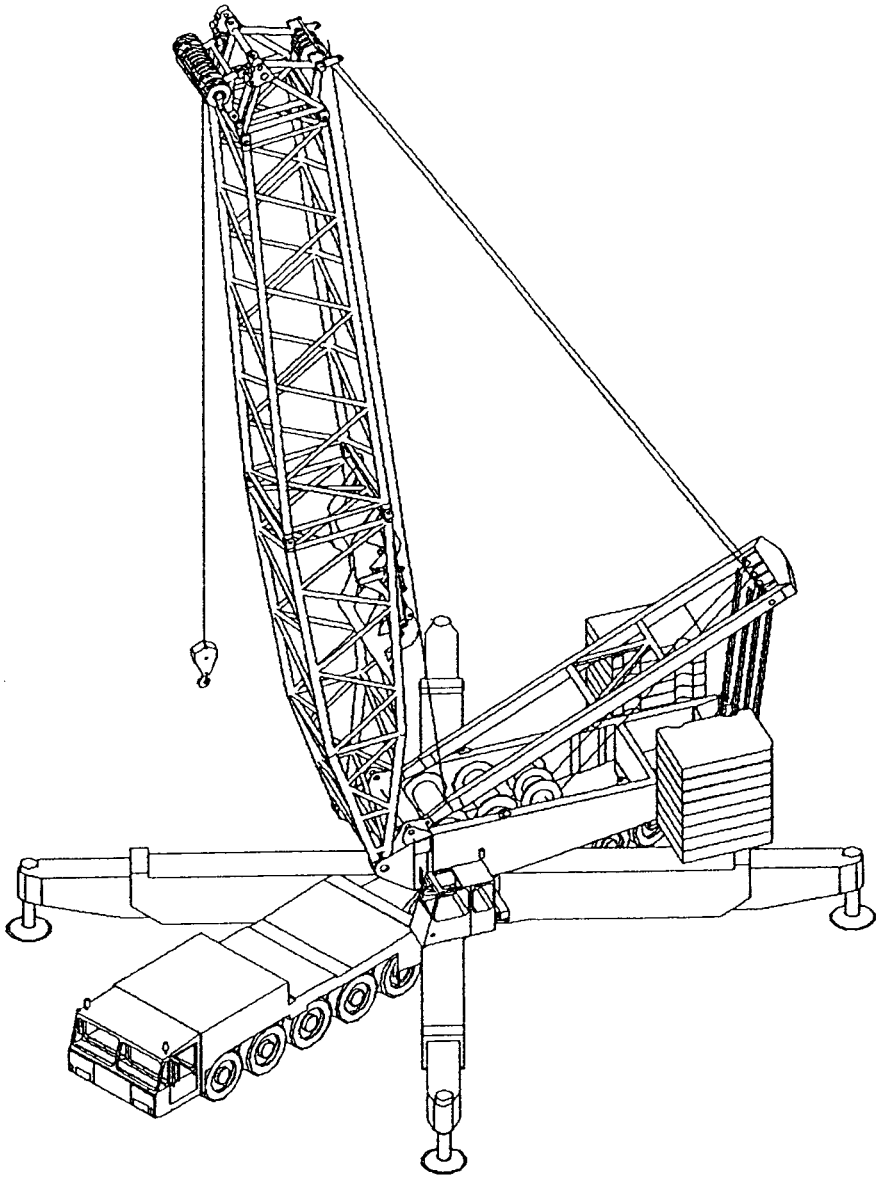
Figure 9 (PRIOR ART)
FIGS. 9-13 show diagrams of the prior art.
Figure 10:
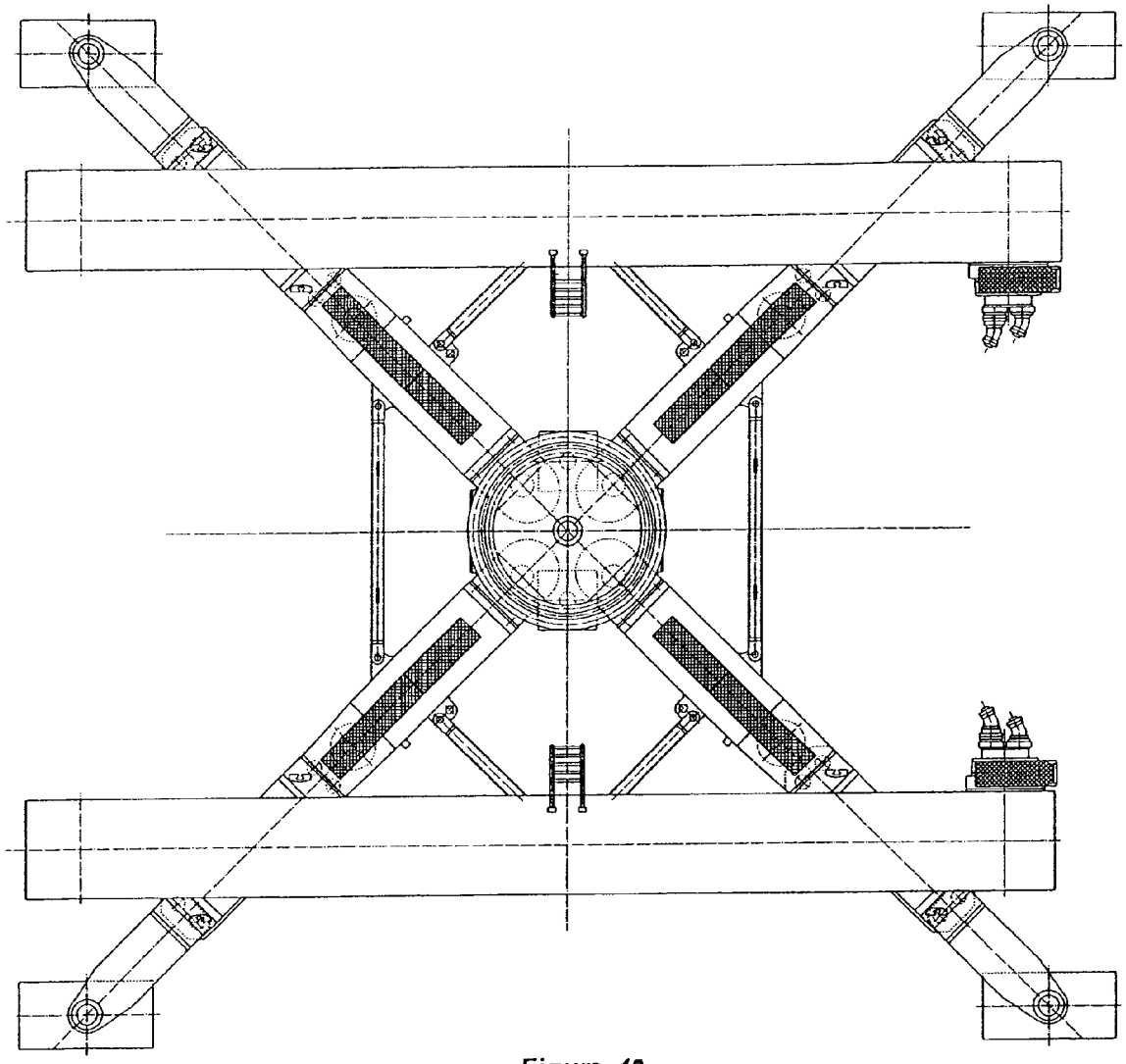
Figure 10 (PRIOR ART)
Figure 11:
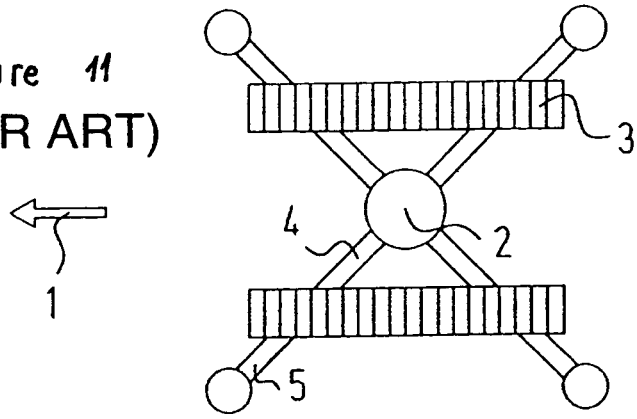
Figure 11 (PRIOR ART)
Figure 12:
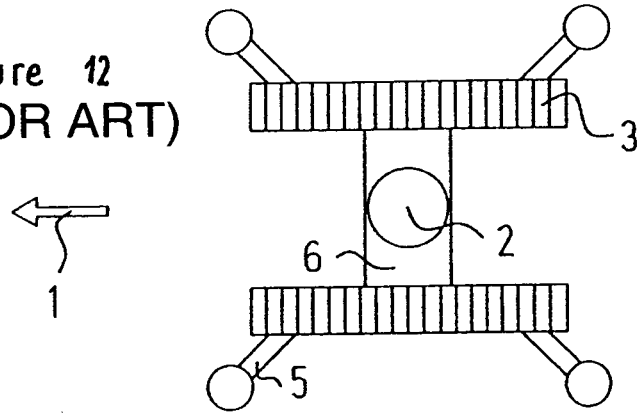
Figure 12 (PRIOR ART)
Figure 13:
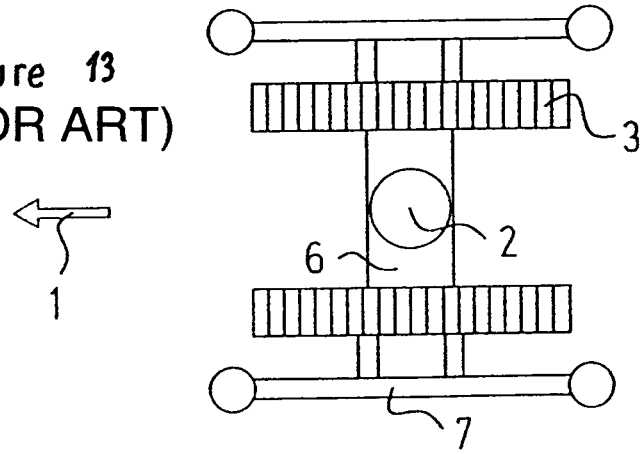
Figure 13 (PRIOR ART)
Figure 14:
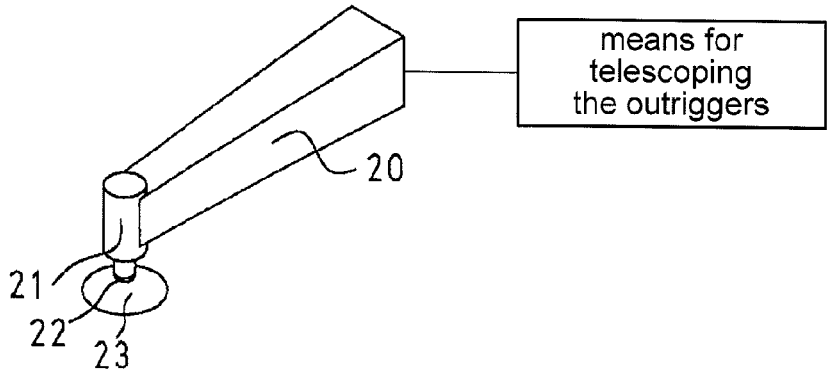
Figure 15:
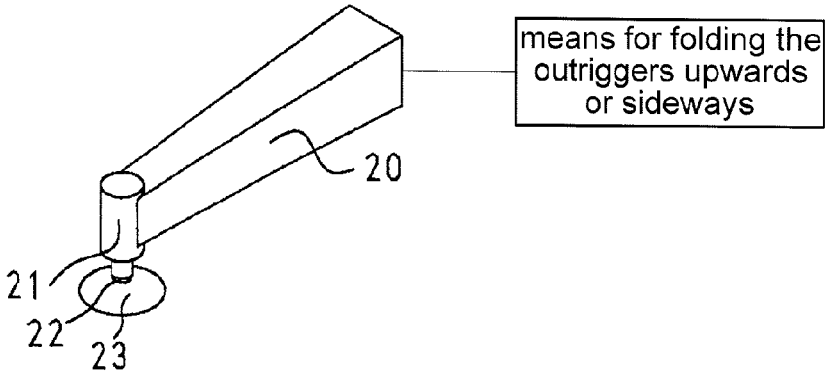

FIGS. 7 and 8 also show hinge joints 20*a* and 20*b*, respectively, which allow the outrigger 20 to fold sideways or upwards. FIG. 7 also shows a hydraulic or spindle drive 24*a* which is used to extend the lateral outriggers 24.

What is claimed is:

1. A narrow track crawler type carriage mobile crane comprising:

an undercarriage comprising a middle section and two parallel crawler carriages defining a longitudinal direction;

a superstructure on which a boom is mounted, the superstructure being connected to the undercarriage by a rotary joint;

only two longitudinal outriggers connected to the undercarriage and extending in the longitudinal direction between the crawler carriages; and only two transverse outriggers connected to the undercarriage and extending outside crawler carriages, transverse to the longitudinal direction;

wherein the outriggers are provided for increasing a size of a support base of the crane;

wherein at least one of said transverse outriggers is attached directly to one of said crawler carriages; and wherein the outriggers can be folded upward or sideways.

2. The mobile crane of claim 1 wherein at least one of the longitudinal outriggers is attached to the middle section.

3. The mobile crane of claim 1 wherein at least one of the outriggers has an end provided with an extendible outrigger cylinder.

4. A narrow track crawler type carriage mobile crane comprising:

an undercarriage comprising a middle section and two parallel crawler carriages defining a longitudinal direction;

a superstructure on which a boom is mounted, the superstructure being connected to the undercarriage by a rotary joint;

two longitudinal outriggers connected to the undercarriage and extending in the longitudinal direction between the crawler carriages; and two transverse outriggers connected to the undercarriage and extending outside crawler carriages, transverse to the longitudinal direction;

wherein the outriggers are provided for increasing a size of a support base of the crane and wherein at least one of said transverse outriggers has a top surface fixed to the middle section and a bottom surface attached to one of said crawler carriages, wherein the top surface comprises a section that is arranged above said crawler carriage.

5. The mobile crane of claim 4 wherein at least one of said transverse outriggers is attached directly to one of said crawler carriages.

6. The mobile crane of claim 4 wherein at least one of the longitudinal outriggers is attached to the middle section.

7. The mobile crane of claim 4 wherein at least one of the longitudinal outriggers is attached to the middle section and to the crawler carriages.

8. The mobile crane of claim 4 wherein at least one of the longitudinal outriggers is attached to each internal side of the crawler carriages, wherein the internal sides are facing the middle section.

9. The mobile crane of claim 4 wherein the outriggers are telescoping.

10. The mobile crane of claim 4 wherein the outriggers can be folded upward or sideways.

11. The mobile crane of claim 4 wherein at least one of the outriggers has an end provided with an extendible outrigger cylinder.

12. A narrow track crawler type carriage mobile crane comprising:

an undercarriage comprising a middle section and two parallel crawler carriages defining a longitudinal direction;

a superstructure on which a boom is mounted, the superstructure being connected to the undercarriage by a rotary joint;

two longitudinal outriggers connected directly to the undercarriage and extending in the longitudinal direction between the crawler carriages; and two transverse outriggers connected directly to the undercarriage and extending outside crawler carriages, transverse to the longitudinal direction;

wherein the outriggers are provided for increasing a size of a support base of the crane and wherein at least one of the longitudinal outriggers is attached directly to the middle section and directly to the crawler carriages, wherein at least one of the outriggers has an end provided with an extendible outrigger cylinder; and wherein the outriggers are telescoping.

13. The mobile crane of claim 12 wherein at least one of said transverse outriggers is attached directly to one of said crawler carriages.

14. The mobile crane of claim 12 wherein at least one of the longitudinal outriggers is attached to each internal side of the crawler carriages, wherein the internal sides are facing the middle section.

15. A narrow track crawler type carriage mobile crane comprising:

an undercarriage comprising a middle section and two parallel crawler carriages defining a longitudinal direction;

a superstructure on which a boom is mounted, the superstructure being connected to the undercarriage by a rotary joint;

two longitudinal outriggers connected directly to the undercarriage and extending in the longitudinal direction between the crawler carriages; and two transverse outriggers connected directly to the undercarriage and extending outside crawler carriages, transverse to the longitudinal direction;

wherein the outriggers are provided for increasing a size of a support base of the crane and wherein at least one of the longitudinal outriggers is attached directly to the middle section and directly to the crawler carriages, wherein at least one of the outriggers has an end provided with an extendible outrigger cylinder; and wherein the outriggers can be folded upward or sideways.

16. The mobile crane of claim 15 wherein at least one of said transverse outriggers is attached directly to one of said crawler carriages.

17. The mobile crane of claim 15 wherein at least one of the longitudinal outriggers is attached to each internal side of the crawler carriages, wherein the internal sides are facing the middle section.

* * * * *

UNITED STATES PATENT AND TRADEMARK OFFICE

CERTIFICATE OF CORRECTION

PATENT NO. : 8,499,945 B2
APPLICATION NO. : 11/992718
DATED : August 6, 2013
INVENTOR(S) : Karp et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 231 days.

Signed and Sealed this
Fifteenth Day of September, 2015

Michelle K. Lee

Michelle K. Lee
*Director of the United States Patent and Trademark Office*